US006615912B2

(12) United States Patent
Garner

(10) Patent No.: US 6,615,912 B2
(45) Date of Patent: Sep. 9, 2003

(54) POROUS VAPOR VALVE FOR IMPROVED LOOP THERMOSIPHON PERFORMANCE

(75) Inventor: Scott D. Garner, Lititz, PA (US)

(73) Assignee: Thermal Corp., Stanton, DE (US)

( * ) Notice: Subject to any disclaimer, the term of this patent is extended or adjusted under 35 U.S.C. 154(b) by 0 days.

(21) Appl. No.: 09/885,472

(22) Filed: Jun. 20, 2001

(65) Prior Publication Data

US 2002/0195242 A1 Dec. 26, 2002

(51) Int. Cl.[7] ..... F28D 15/00

(52) U.S. Cl. ..... 165/104.26; 165/104.33; 165/274

(58) Field of Search ..... 165/104.26, 32; 62/52, 101

(56) References Cited

U.S. PATENT DOCUMENTS

| | | | | |
|---|---|---|---|---|
| 4,201,263 A | | 5/1980 | Anderson | 165/146 |
| 4,380,907 A | * | 4/1983 | Barnes et al. | 62/52 |
| 4,441,548 A | | 4/1984 | Franklin et al. | 165/104.26 |
| 4,470,759 A | | 9/1984 | Kosson | 417/208 |
| 4,524,587 A | * | 6/1985 | Kantor | 62/101 |
| 4,611,654 A | | 9/1986 | Buchsel | 165/104.22 |
| 4,765,396 A | * | 8/1988 | Seidenberg | 165/104.26 |
| 5,076,352 A | | 12/1991 | Rosenfeld et al. | 165/104.26 |
| 5,103,897 A | * | 4/1992 | Cullimore et al. | 165/32 |
| 5,203,399 A | | 4/1993 | Koizumi | 165/104.33 |
| 5,566,751 A | | 10/1996 | Anderson et al. | 165/104.27 |
| 5,695,007 A | | 12/1997 | Fauconnier et al. | 165/128 |
| 5,842,513 A | * | 12/1998 | Maciaszek et al. | 165/104.26 |
| 5,966,957 A | | 10/1999 | Mälhammar et al. | 62/259.2 |
| 6,330,907 B1 | * | 12/2001 | Ogushi et al. | 165/104.26 |

FOREIGN PATENT DOCUMENTS

GB 2127143 A * 4/1984

OTHER PUBLICATIONS

Thermo–siphon Type Hot Water Circulating System Article, Internet pp. 1–2, dated Dec. 4, 2000.

Thermacore International Inc.'s Web Home Page on Frequently Asked Questions About Heat Pipes, Internet pp. 1–4, dated Dec. 21, 2000.

Heat Pipe Article From McGill University, Department of Mining and Metallurgical Engineering, Internet pp. 1–9, dated Jan. 16, 2001.

ADB Energy Efficiency Support Project Article, Internet pp. 1–4, dated Jan. 19, 2001.

Niro, Inc. Web Page on Evaporator Systems, Internet pp. 1–3, dated Jan. 19, 2001.

Article on Compact, Double Side Impingement, Air–to–Air Heat Exchanger, by Z.J. Zuo, E.H. Dubble and S.D. Garner, pp. 1–8.

* cited by examiner

*Primary Examiner*—Henry Bennett
(74) *Attorney, Agent, or Firm*—Duane Morris LLP

(57) ABSTRACT

The present invention provides a loop thermosiphon including an evaporator and a condenser interconnected in flow communication by a vapor conduit and a condensate conduit. A wick is disposed in a portion of the evaporator and a portion of the at least one condensate conduit adjacent to the evaporator to facilitate capillary action to cycle a coolant fluid through the loop thermosiphon. Advantageously, a porous valve is lodged within the condensate conduit so that a first pressure on a condenser side of the porous valve is greater than a second pressure on an evaporator side of the porous valve. In this way, a portion of the liquid coolant fluid disposed within the loop thermosiphon is forced through the porous valve and a remaining portion is forced through the at least one condenser. In one embodiment, the porous valve comprises a plug of sintered material that is lodged within the condensate conduit so as to provide a seepage of coolant fluid during periods of low thermal energy transfer to the evaporator so as to avoid drying out of the system.

22 Claims, 3 Drawing Sheets

POROUS VAPOR VALVE FOR IMPROVED LOOP THERMOSIPHON PERFORMANCE

FIELD OF THE INVENTION

The present invention relates to thermosiphons, and more particularly to a thermosiphon that resists dry-out conditions and is self starting.

BACKGROUND OF THE INVENTION

The use of thermosiphons is well known in the art for cooling various types of electronic devices and equipment, such as integrated circuit chips and components. A thermosiphon absorbs heat by vaporizing liquid on an evaporating or boiling surface and transferring the vapor to a condenser where it cools and condenses into a liquid. Gravity then returns the liquid to the evaporator or boiler to repeat the cycle. Thus, a loop thermosiphon is formed by an evaporator and a condenser which are incorporated in a pipe circuit. The circuit is sealed and filled with a suitable working fluid. In order for the circuit to function, it is necessary for the condenser to be located somewhat above the evaporator. When heat is delivered to the evaporator, part of the fluid will boil off so that a mixture of liquid and gas rises to the condenser. The vapor condenses in the condenser and heat is released. The liquid thus formed then runs back to the evaporator under its own weight.

Thermosiphon circuits are normally very efficient heat transporters, inasmuch as heat can be transported through long distances at low temperature losses. Thermosiphon circuits can therefore be used advantageously for different cooling purposes. There is also generally a great deal of freedom in the design of the evaporator and condenser. In the context of electronic component cooling, however, the components to be cooled are normally very small, which means that the evaporator must be of comparable size. The external cooling medium used is normally air, which in turn means that the condenser must have a large external surface area.

One of the drawbacks with prior art thermosiphons is that the condenser must be sufficiently elevated to allow the condensed working fluid to flow back to the evaporator. It is beneficial to design U-Tubes or liquid tops in the condenser design to allow a higher gravity head during operation or to allow a portion of the condenser to be located below the evaporator. These designs work once they are operating, but can dry out the evaporator when not in use, thus requiring special start up procedures.

The wick structure and evaporator portion of the prior art are known to dry out when the thermosiphon is in a non-operating condition. While in this condition the wick structure and evaporator portion dry out to the point that there is not enough liquid in the evaporator portion to evaporate and create enough pressure to force condensate to return to the evaporator. This typically happens when the equipment to be cooled is turned off. When this equipment is turned off, heat is not provided to the evaporator portion. Thus, liquid flow is retarded by the decrease of pressure in the evaporator portion. This allows fluid to accumulate in the condenser region and dry out the evaporator region. Once a prior art loop thermosiphon is in this dry out condition, it can not be restarted until the evaporator portion contains sufficient liquid to evaporate. Simply applying heat to the evaporator portion will not restart thermosiphon flow. If insufficient liquid exists in the evaporator portion, applying heat may damage the thermosiphon, and possibly damage the equipment to be cooled.

One possible restarting means is to pump liquid to the evaporator portion. Alternatively, a heater can be added to the condenser section to drive the liquid back to the evaporator prior to startup. Adding pumps or adjunct heaters to a prior art loop thermosiphon alters the system from a passive system to an active system. A loop thermosiphon may be operated as a passive system, requiring no external electrical power. As a passive system, heat is provided to the evaporator portion by the equipment to be cooled, and the condenser portion is cooled by the ambient surroundings. Disadvantages of implementing adjunct heaters and/or pumps to loop thermosiphons include the additional power required, the additional space consumed, the additional system costs, and the increased possibility of malfunctioning components. Thus, a need exists for a thermosiphon which does not suffer the above disadvantages.

SUMMARY OF THE INVENTION

The present invention provides a loop thermosiphon comprising of an evaporator and a condenser interconnected in flow communication by at least one vapor conduit and at least one condensate conduit. A wick is disposed in a portion of the evaporator and a portion of the at least one condensate conduit adjacent to the evaporator to facilitate capillary action to cycle a coolant fluid through the loop thermosiphon. Advantageously, a porous valve is lodged within the condensate conduit. This porous valve will act as a pressure barrier for vapor, forcing the vapor through an alternate condenser flow path. This the vapor pressure within this alternate flow path increases the gravity head of the condensed working fluid. During periods of inactivity, the porous valve will allow liquid to flow freely in both directions preventing a buildup of liquid in the condenser and a potential dry out condition in the evaporator system.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE INVENTION

Figure 1:
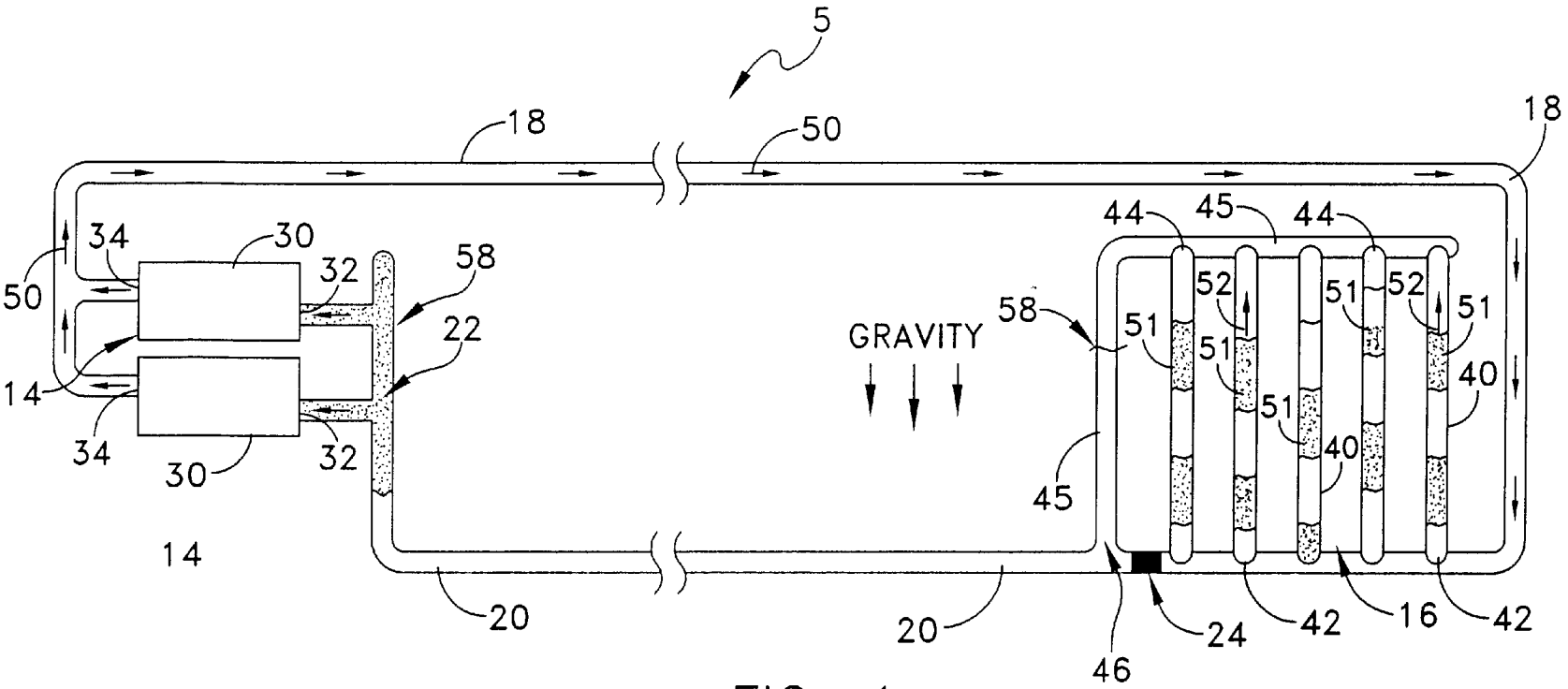
FIG. 1 is a schematic diagram of a loop thermosiphon having a porous valve formed in accordance with the present invention and representing a normal operating condition.

This description of preferred embodiments is intended to be read in connection with the accompanying drawings, which are to be considered part of the entire written description of this invention. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly"

versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Referring to FIG. 1, a loop thermosiphon 5 formed in accordance with the present invention comprises one or more evaporators 14, one or more condensers 16, at least one vapor conduit 18, at least one condensate conduit 20, a wick 22, and a porous valve 24. Loop thermosiphon 5 is charged with a suitable coolant fluid 7, e.g., water, freon, alcohol, acetone, or some other fluid known in the art for use in heat transfer devices, and which is capable of rapid vaporization and condensation within a closed loop environment. Parameters to be considered when selecting coolant fluid 7 include the amount of pressure that can be safely applied to each evaporator, the operating temperature of the equipment to be cooled, the rate of heat transfer, the temperatures reached within each evaporator, the viscosity of coolant fluid 7, and the boiling point of coolant fluid 7. Loop thermosiphon 5 is sealed to the ambient atmosphere so as to form a closed loop system.

Evaporators 14 comprise at least one chambered enclosure 30 having an inlet opening 32 and an outlet opening 34. Inlet opening 32 is arranged in flow communication with condenser 16, via condensate conduit 20, and outlet opening 34 is arranged in flow communication with condenser 16, via vapor conduit 18.

Chambered enclosures 30 are arranged in intimate thermal engagement with a source of thermal energy, such as an integrated circuit chip or chips, or an electronic device comprising such chips or other heat generating structures known in the art (not shown). Evaporators 14 may include external and/or internal features and structures to aid in the rapid vaporization of coolant fluid 7. For example, an externally applied thermally conductive coating may used to enhance heat transfer and spreading from the heat source throughout evaporator 14, or a sintered internal surface coating or heat pipe structures may be included in evaporator 14 for the purpose of spreading and transferring heat generated by the electronic components evenly throughout the evaporator.

Evaporator 14 acts as a heat exchanger transferring the heat given off by the equipment being cooled to coolant fluid 7. As coolant fluid 7 is heated, the pressure within each chambered enclosure 30 increases, vaporizing the saturated fluid contained in the evaporator. The vapor flows through vapor conduit 18, toward condenser 16, i.e., in the direction of arrows 50 in FIG. 1. Evaporator 14 may comprise any type of evaporator having the capability to facilitate the transfer of thermal energy to coolant fluid 7. Some types of evaporators that have been found to be useful when used in connection with this invention include, tube evaporators, rising film evaporators, falling film evaporators, plate evaporators, and layered wick evaporators. For example, in one embodiment of the invention, evaporator 14 comprises a layered wick evaporator, having a wick formed on the interior surfaces of chambered enclosure 30, and in flow communication with wick 22.

Vapor conduit 18 and condensate conduit 20 may have a conventional structure that is capable of transferring coolant fluid 7 between evaporators 14 and condenser 16. For example, vapor conduit 18 and condensate conduit 20 may be separate structures (e.g., tubes or pipes), or may be formed from a single structure, e.g., multiple channels molded or cut into single or multiple blocks.

Wick 22 is positioned on the inner surfaces of each inlet opening 32 and the inner surfaces of the portion of condensate conduit 20 that engages inlet opening 32. Wick 22 may comprise any of the typical heat pipe wick structures such as grooves screen, cables, adjacent layers of screening, felt, or sintered powders, and may extend onto the inner surfaces of chambered enclosure 30. Wick 22 draws liquid into evaporator 14 from condensate conduit 20 by capillary action.

Condensers 16 typically comprise a plurality of ducts 40 having an inlet opening 42 and an outlet opening 44. Inlet opening 42 is arranged in flow communication with evaporator 14, via vapor conduit 18, and outlet opening 44 is arranged in flow communication with evaporator 14, via return duct 45 and condensate conduit 20. Condenser 16 acts as a heat exchanger transferring heat contained in a mixture of vaporous coolant fluid 7 and liquid coolant fluid 7 to the ambient surroundings. Condenser 16 may comprise a conventional condenser having the capability to facilitate transfer of thermal energy. Plurality of ducts 40 are often arranged within a heat transfer device, such as a fin stack, cold plate or heat exchanger of the type well known in the art. In one embodiment of the invention, plurality of ducts 40 are thermally engaged with a conventional fin stack that is adapted to utilize air flow for the transfer of heat. In another embodiment, condenser 16 comprises cooling fins, each having a large surface area for efficient transfer of thermal energy, and with a portion of each cooling fin thermally engaged with at least one of plurality of ducts 40.

In operation, as the mixture of vaporous coolant fluid 7 and liquid coolant fluid 7 enters plurality of ducts 40, the mixture condenses into a liquid as a result of the heat transferred from the mixture to the ambient surroundings via the cooling fins. Condenser 16 may be cooled by various other methods known in the art, such as forced liquid or air, or large surface areas of condenser 16 exposed to ambient surroundings.

Figure 2:
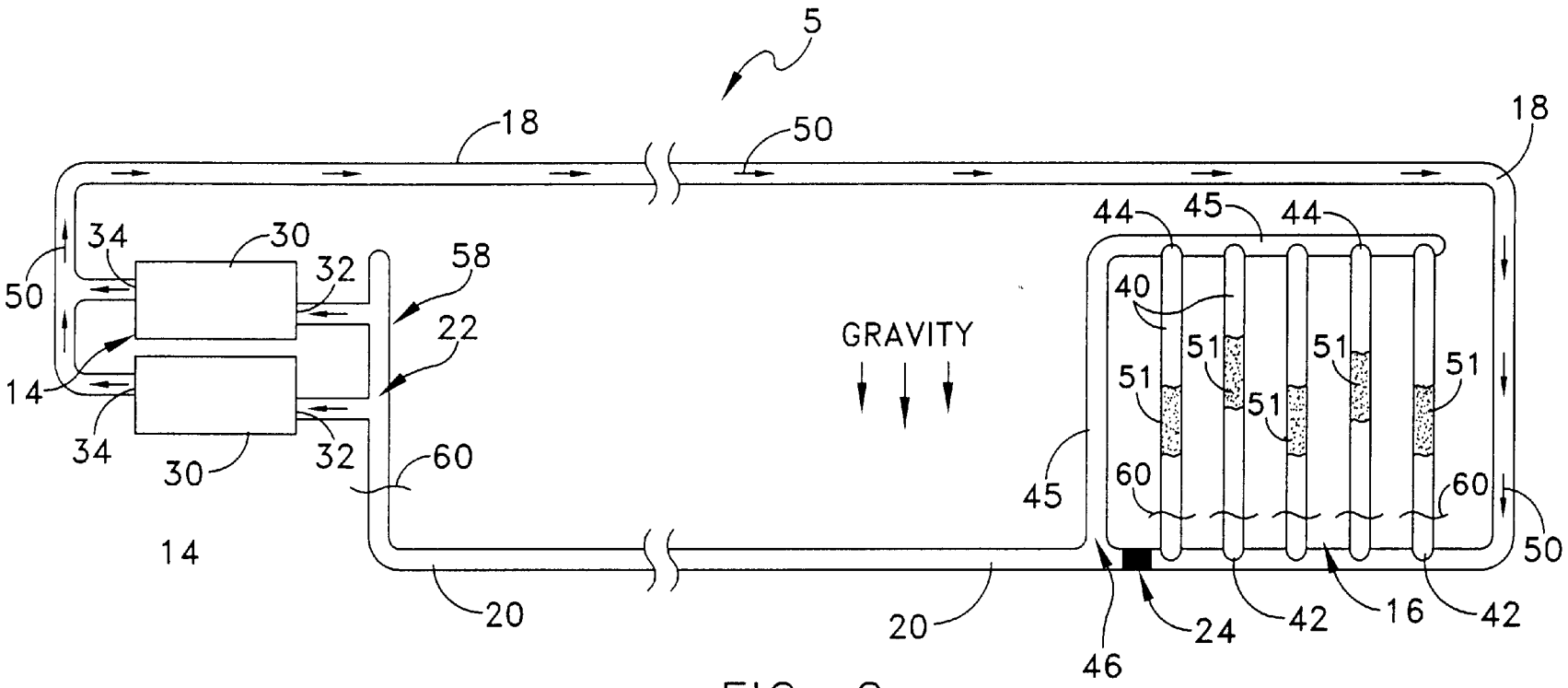
FIG. 2 is a schematic diagram of the loop thermosiphon shown in FIG. 1, but showing a non-operating condition.
Figure 3:
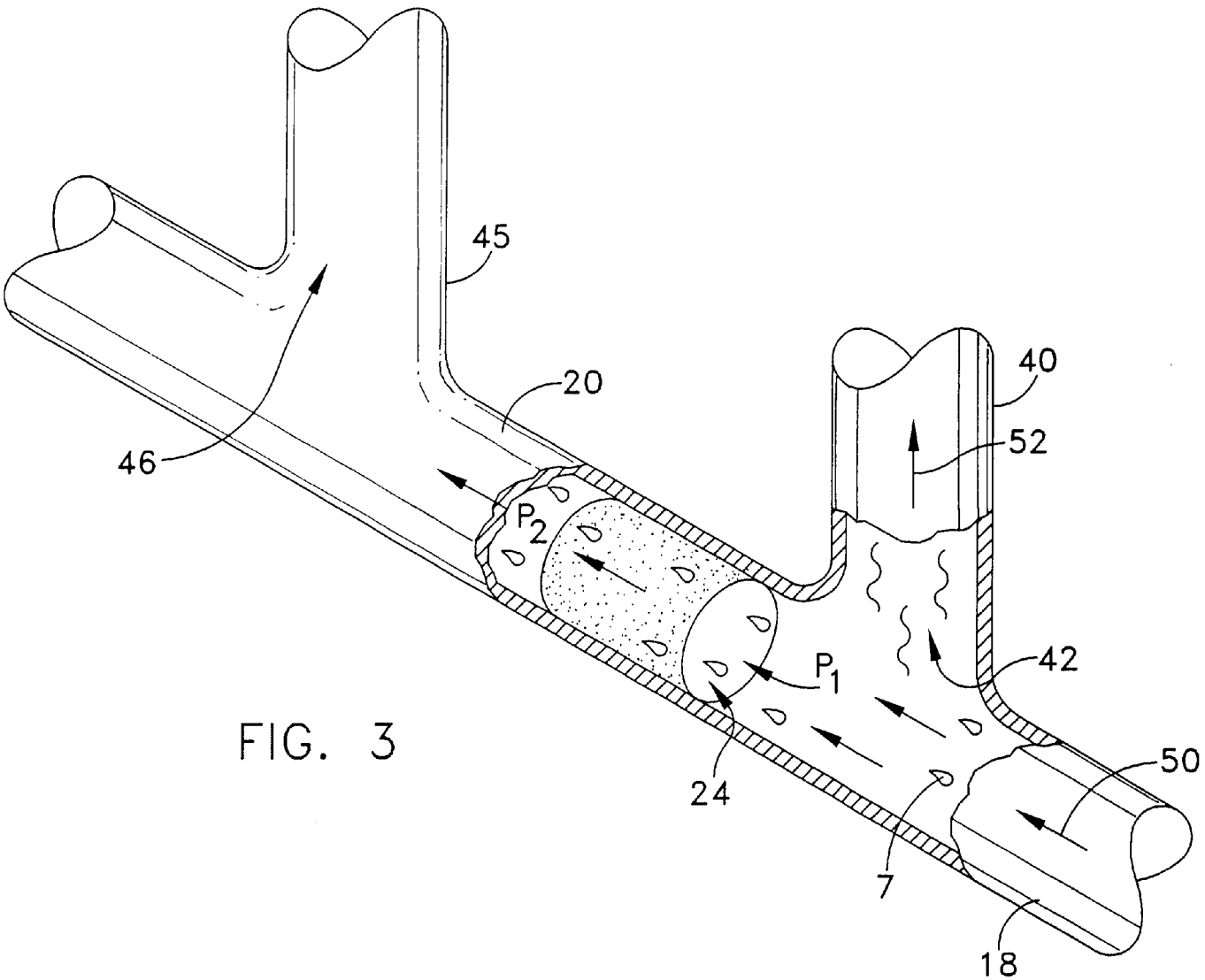
FIG. 3 is an enlarged broken-away and partially sectional view of a portion of the loop thermosiphon shown in FIGS. 1 and 2, showing a porous valve formed in accordance with the invention.

Referring to FIGS. 1, 2, and 3, porous valve 24 comprises a plug of poriferous material, lodged within condensate conduit 20, that is permeable to coolant fluid 7, but at a significantly reduced rate as compared to an unobstructed portion of condensate conduit 20. As such, porous valve 24 forms a seeping barrier to liquid coolant fluid 7 within condensate conduit 20. In one embodiment of the present invention, porous valve 24 may be formed from a sintered material, e.g., copper, with pores sized in a range from about 25 um to about 150 um, with pores sized in the range of 50 um to about 80 um being preferred for most applications using water for coolant fluid 7. The length of porous valve 24 may be set according to the flow rate through the valve that is needed to prevent drying out of wick 22, as will hereinafter be disclosed in further detail. Porous valve 24 is positioned within condensate conduit 20, adjacent to outlet opening 46 of return duct 45.

In order to operate loop thermosiphon 5 according to the present invention, the equipment to be cooled (not shown) is thermally coupled to a portion of evaporator 14. A portion of the packaging containing the equipment to be cooled is often attached directly to evaporator 14 by a thermally conductive material or fastener of the type well known in the art. As thermal energy is transferred from the equipment to be cooled to evaporator 14, coolant fluid 7 within chambered enclosure 30 begins to evaporate (i.e., boil). As coolant fluid 7 boils, the pressure within evaporator 14 increases, which in turn forces a mixture of vaporous coolant fluid 7 and liquid coolant fluid 7 to flow along vapor conduit 18 toward condenser 16. Slugs of liquid 51 are formed by the condensation of the mixture of vapor/liquid coolant 7 within plurality of ducts 40. As the vapor pressure within evaporator 14 increases, it also forces slugs of liquid 51 to flow up each of plurality of ducts 40 in condenser 16, as indicated by arrows 52 in FIGS. 1 and 3. As slugs of liquid 51 reach the top of condenser 16, they are forced to flow out of outlet opening 44, into return duct 45, and downwardly through outlet opening 46 to condensate conduit 20 by gravity.

Referring to FIGS. 1 and 3, during normal operating conditions mixture of vaporous coolant fluid 7 and/or liquid coolant 7 flows in the direction of arrows 50 (FIG. 1). Liquid level 58 marks an approximate level of liquid coolant fluid 7 within condenser 16 and condensate conduit 20 while loop thermosiphon 5 is operating normally. When liquid coolant fluid 7 is at level 58, wick 22 is sufficiently moistened to maintain thermosiphon operation. In this operating condition porous valve 24 prevents vapor 50 from flowing directly from vapor conduit 18 to condensate conduit 20, and forces it through plurality of ducts 40. Referring to FIG. 3, also during normal operation of loop thermosiphon 5, pressure P1, on the condenser side of porous valve 24 is greater than the pressure P2, on the evaporator side of porous valve 24. When P1 is greater than P2, the capillary forces generated by the saturated porous valve are equal to $2\ T/r_c\Theta$, where T equals the surface tension of the fluid, $r_c$ equals pore radius, and $\Theta$ wetting angle. This capillary force prevents vapor from flowing through the porous valve 24. Thus, the mixture of liquid and vapor is forced up through plurality of ducts 40 as slugs 51.

Referring to FIGS. 1 and 2, porous valve 24 advantageously eliminates drying out of wick 22 and evaporator 14 when loop thermosiphon 5 is not operating by allowing a portion of liquid coolant fluid 7 to seep into condensate conduit 20 from condenser 16, and thereby to maintain wick 22 in a moistened condition. More particularly, and referring to FIG. 2, loop thermosiphon 5 is not operating when evaporators 14 are not being heated and there is no liquid coolant fluid 7 flowing between condensers 16 and evaporators 14. For example, this situation typically occurs when the equipment to be cooled is not operating or generating thermal energy. While loop thermosiphon 5 is in this non-operating condition, it would be possible for the working fluid to accumulate in plurality of ducts 40. This would allow the liquid level to rise to level 61 with no flow back to evaporators 14, completely drying them out. However, with the porous valve 24 in place, the force of gravity exerted on these columns of liquid increases P1. In turn, liquid seeps through porous valve 24 from the condenser side to the evaporator side, until P1 is approximately equal to P2. At this point the level of liquid in plurality of ducts 40 is approximately at level 60 (FIG. 2). This is also the approximate level of liquid at wick 22. Because liquid is always present at wick 22, liquid is always available to be drawn into evaporator 14. Thus, the dry out condition that is associated with prior art loop thermosiphons during the non-operating condition is eliminated.

Loop thermosiphon 5 may be restarted by simply starting the equipment to be cooled. Because sufficient liquid is present in evaporator 14, as heat is transferred to evaporator 14, thermosiphon action begins and liquid coolant fluid 7 starts to flow. Thus, a loop thermosiphon 5 in accordance with the present invention may be restarted without any active components (e.g., pumps, adjunct heaters).

It is to be understood that the present invention is by no means limited only to the particular constructions herein disclosed and shown in the drawings, but also comprises any modifications or equivalents within the scope of the claims.

What is claimed is:

1. A loop thermosiphon comprising:

at least one evaporator for converting a fluid to a vapor;

at least one condenser including a plurality of ducts each having an inlet opening and an outlet opening, wherein each of said outlet openings is in flow communication with a return duct which is disposed in flow communication between said outlet openings and a condensate conduit;

at least one vapor conduit interconnecting said evaporator and said condenser in flow communication wherein said inlet openings of said at least one condenser are in flow communication with said at least one vapor conduit and said at least one evaporator and further wherein said condensate conduit interconnects said evaporator and said condenser in flow communication so as to comprise a first gravity head when said evaporator is converting said fluid to said vapor, and a second gravity head when said evaporator is inactive; and a porous plug lodged within said condensate conduit between said inlet opening of said at least one condenser and said return duct so as to (i) divert said vapor when said loop thermosiphon comprises said first gravity head, and (ii) allow said fluid to flow freely back to said evaporator when said loop thermosiphon comprises said second gravity head thereby preventing a buildup of fluid in said condenser and a potential dry out condition in said evaporator.

2. A loop thermosiphon according to claim 1 wherein said porous plug forms a valve that is (i) permeable to a liquid, and (ii) presents a barrier to vapor flow.

3. A loop thermosiphon according to claim 2 wherein said porous plug is formed from a sintered powder metal.

4. A loop thermosiphon according to claim 1 wherein said porous plug comprises pores sized in a range from about 5 um to about 200 um.

5. A loop thermosiphon comprising:

at least one evaporator;

at least one condenser;

at least one vapor conduit interconnecting said evaporator and said condenser in flow communication;

at least one condensate conduit interconnecting said evaporator and said condenser in flow communication;

a flow channel positioned in parallel between a vapor inlet to said at least one condenser and a condensate outlet to said at least one evaporator; and a porous plug lodged within said condensate conduit and positioned between said parallel flow channel and said vapor inlet to said at least one condenser wherein a first pressure on a condenser side of said porous plug is greater than a second pressure on an evaporator side of said porous plug such that a mixture of liquid and vapor is forced up through said at least one condenser thereby diverting said liquid and vapor when said loop thermosiphon comprises a first gravity head, and (ii) allowing said fluid to flow freely back to said evaporator when said loop thermosiphon comprises a second gravity head thereby preventing a buildup of fluid in said condenser and a potential dry out condition in said evaporator.

6. A loop thermosiphon according to claim 5 wherein said at least one evaporator comprises at least one chambered enclosure having an inlet opening and an outlet opening wherein said inlet opening is in flow communication with said at least one condensate conduit and said at least one condenser, and said outlet opening is in flow communication with said at least one vapor conduit and said at least one condenser.

7. A loop thermosiphon according to claim 6, comprising a wick disposed adjacent to said inlet opening.

8. A loop thermosiphon according to claim 7 wherein said wick comprises at least one of adjacent layers of screening, sintered powder, and sintered powder with interstices positioned between powder particles.

9. A loop thermosiphon according to claim 5 wherein said at least one evaporator comprises at least one of a tube evaporator, a rising film evaporator, a falling film evaporator, a plate evaporator, and a layered wick evaporator.

10. A loop thermosiphon according to claim 6 wherein said at least one evaporator comprises a layered wick evaporator, having a wick formed on an interior surface of said chambered enclosure and is interconnected in flow communication with a wick disposed within a portion of said condensate conduit.

11. A loop thermosiphon according to claim 6 wherein said wick comprises at least one of an integrally formed layer of aluminum-silicon-carbide (AlSiC) and copper-silicon-carbide (CuSiC) having an average thickness of about 0.5 mm to 1.0 mm.

12. A loop thermosiphon according to claim 11 wherein said wick comprises at least one of adjacent layers of screening, sintered powder, grooves, and felt.

13. A loop thermosiphon according to claim 6 wherein said plurality of ducts are positioned within a fin stack heat exchanger.

14. A loop thermosiphon according to claim 5 wherein said porous plug forms a valve that is permeable to said liquid at a significantly reduced flow rate relative to a flow rate for an unobstructed portion of said condensate conduit.

15. A loop thermosiphon according to claim 14 wherein said porous plug is formed from at least one of copper, aluminum-silicon-carbide and copper-silicon-carbide.

16. A loop thermosiphon according to claim 5 wherein said porous plug comprises pores sized in a range from about 5 um to about 200 um.

17. A loop thermosiphon according to claim 5 wherein said porous plug is positioned within said condensate conduit adjacent to an outlet opening of said flow channel.

18. A loop thermosiphon according to claim 17 comprising a first pressure on a condenser side of said porous plug which is greater that a second pressure on an evaporator side of said porous plug such that a portion of a liquid disposed within said loop thermosiphon is forced through said porous valve plug and a remaining portion comprising a mixture of liquid and vapor is forced up through said at least one condenser.

19. A loop thermosiphon comprising an evaporator having a liquid inlet and a condenser having a vapor inlet, and interconnected in flow communication by at least one vapor conduit and at least one condensate conduit and a having a wick disposed in a portion of said evaporator and a portion of said at least one condensate conduit adjacent to said evaporator;

a flow channel positioned in parallel between said vapor inlet to said condenser and said liquid inlet to said evaporator; and a coolant fluid disposed within said loop thermosiphon; and a porous valve lodged within said condensate conduit between said flow channel and said vapor inlet to said condenser wherein a first pressure on a condenser side of said porous valve is greater than a second pressure on an evaporator side of said porous valve such that a portion of said coolant fluid disposed within said loop thermosiphon is forced through said porous valve and a remaining portion comprising a mixture of liquid and vapor is forced up through said at least one condenser thereby diverting said liquid and vapor when said loop thermosiphon comprises a first gravity head, and (ii) allowing said fluid to flow freely back to said evaporator when said loop thermosiphon comprises a second gravity head thereby preventing a buildup of fluid in said condenser and a potential dry out condition in said evaporator.

20. A loop thermosiphon according to claim 19 wherein said porous plug is porous to said coolant fluid in a liquid state and semipermeable to said coolant fluid in a vaporous state.

21. A loop thermosiphon comprising:

at least one evaporator including at least one chamber having an inlet opening, an outlet opening, and a wick disposed adjacent to said inlet opening;

at least one condenser including a plurality of ducts, each having an inlet opening and an outlet opening;

at least one vapor conduit interconnecting said evaporator outlet opening and said condenser inlet opening;

at least one condensate conduit interconnecting said evaporator inlet opening and said condenser outlet opening;

a return duct disposed in flow communication between said outlet openings and said at least one condensate conduit; and a seeping barrier positioned within said condensate conduit between said inlet openings of said at least one condenser and said return duct wherein a first pressure on a condenser side of said seeping barrier is greater than a second pressure on an evaporator side of said seeping barrier such that a portion of said liquid coolant fluid disposed within said loop thermosiphon seeps through said barrier and a remaining portion comprising a mixture of liquid and vapor is forced up through said at least one condenser thereby diverting said liquid and vapor when said loop thermosiphon comprises a first gravity head, and (ii) allowing said fluid to flow freely back to said evaporator when said loop thermosiphon comprises a second gravity head thereby preventing a buildup of fluid in said condenser and a potential dry out condition in said evaporator.

22. A loop thermosiphon comprising:

at least one evaporator;

at least one condenser comprising a plurality of condenser-ducts each having an inlet opening and an outlet opening, wherein said inlet opening is in flow communication with at least one vapor conduit and said at least one evaporator and said outlet opening is in flow communication with a return duct having an outlet opening disposed in flow communication with a condensate conduit and between said condenser-duct inlet openings and said at least one evaporator, said at least one vapor conduit interconnecting said evaporator and said condenser in flow communication, said at least one condensate conduit interconnecting said evaporator and said condenser in flow communication; and a porous plug lodged within said condensate conduit and positioned within said condensate conduit between said outlet opening of said return duct and at least one of said condenser-ducts so as to (i) divert said vapor when said loop thermosiphon comprises said first gravity head, and (ii) allow said fluid to flow freely back to said at least evaporator when said loop thermosiphon comprises said second gravity head thereby preventing a buildup of fluid in said condenser and a potential dry out condition in said at least one evaporator.

* * * * *

UNITED STATES PATENT AND TRADEMARK OFFICE

CERTIFICATE OF CORRECTION

PATENT NO. : 6,615,912 B2
DATED : September 9, 2003
INVENTOR(S) : Garner

It is certified that error appears in the above-identified patent and that said Letters Patent is hereby corrected as shown below:

Title page,
Item [*] Notice, delete "by 0 days" and insert -- by 63 days --

Signed and Sealed this

Twenty-fifth Day of May, 2004

JON W. DUDAS
*Acting Director of the United States Patent and Trademark Office*